United States Patent [19]

Pinto et al.

[11] Patent Number: 4,858,278

[45] Date of Patent: Aug. 22, 1989

[54] APPARATUS FOR CLEANING AND OPENING TEXTILE FIBER MATERIAL

[75] Inventors: Akiva Pinto, Duesseldorf; Guenter Lucasse, Haltern; Rolf R. Jung; Bernhard Bocht, both of Neubulach, all of Fed. Rep. of Germany

[73] Assignee: Hergeth Hollingsworth GmbH, Duelman, Fed. Rep. of Germany

[21] Appl. No.: 176,531

[22] Filed: Apr. 1, 1988

[30] Foreign Application Priority Data

Apr. 7, 1987 [DE] Fed. Rep. of Germany ..... 3711640

[51] Int. Cl.[4] ..... D01G 9/12

[52] U.S. Cl. ..... 19/200; 19/204

[58] Field of Search ..... 19/65 A, 66 R, 200, 19/204, 205

[56] References Cited

U.S. PATENT DOCUMENTS

| | | | |
|---|---|---|---|
| 4,135,276 | 1/1979 | Handschuch et al. | 19/200 X |
| 4,345,356 | 8/1982 | Handschuch et al. | 19/204 X |

FOREIGN PATENT DOCUMENTS

| | | | |
|---|---|---|---|
| 3127544 | 1/1983 | Fed. Rep. of Germany | 19/200 |
| 3131174 | 2/1983 | Fed. Rep. of Germany | 19/200 |
| 34254666 | 1/1986 | Fed. Rep. of Germany | 19/200 |
| 3720037 | 12/1987 | Fed. Rep. of Germany | 19/200 |

*Primary Examiner*—Werner H. Schroeder
*Assistant Examiner*—Douglas E. Price
*Attorney, Agent, or Firm*—Cort Flint

[57] ABSTRACT

An apparatus for cleaning and opening fiber materials is disclosed having an intake roller (3) and an opening roller (5) wherein there is arranged between the intake roller and the opening roller (5) at least one intermediate roller (4) having a relatively small diameter and rotating at a high speed.

21 Claims, 4 Drawing Sheets

APPARATUS FOR CLEANING AND OPENING TEXTILE FIBER MATERIAL

BACKGROUND OF THE INVENTION

The invention relates to an apparatus for cleaning and opening flocks of fiber material, such as natural and/or synthetic fibers. The fiber material is first passed through an intake roller or a pair of intake rollers cooperating with a trough. Subsequently, the fiber material is passed through an opener which includes a cleaner to be finally discharged to a processing machine.

With regard to the cleaner used for the preparation of the fiber material, one has to distinguish between the so-called first, coarse cleaners, and the later, fine cleaners in the fiber preparation line. The coarse cleaners are used to clean the raw fiber material, such as raw cotton, before the bales are formed in compliance with the sales requirements. The fine cleaners are used during the preparatory procedure, for processing the fiber material in advance of, or if necessary, also subsequent to the card, after the raw material of the bales has been opened. As for the fine cleaners, use is made of cleaning and opening means in which the intake rollers directly cooperate with the opening roller. At the opening roller, a cleaning means in the form of a knife grid or the like is provided. Opposite the cleaning means is disposed a suction means for the cleaned fiber material. The cleaning intensity obtainable with such devices is still unsatisfactory. Above all, waste particles are more or less disintegrated by the cleaning procedure. A separation of the disintegrated particles during further processing is either hardly possible or not possible at all.

In case of the coarse cleaners for the raw fiber material, it has been known to provide between the intake means and the opening roller with a cleaner, an intermediate roller cooperating with a cleaner, e.g. a knife grid. In this arrangement, the diameters of intermediate roller and opening rollers are approximately equal and the difference in speed between the two rollers is relatively. Difficulties result concerning the delivery of the fiber material to the opening roller. In order to keep the return side of the clothing of the intermediate roller as clean as possible from fibers, etc., there is provided, on the one hand, a guide plate to guide the fiber flow from one roller to the other. On the other hand, subsequent to the guide plate, there is still a suction means to remove the remaining fibers from the roller clothing. The problem of transferring the fibers from the intermediate roller to the opening roller is not solved satisfactorily this way.

It is the object of the invention to provide a cleaning and opening apparatus for the fine opening of fiber material accompanied by a high cleaning intensity and a high throughput without the need of tolerating a fiber deterioration.

SUMMARY OF THE INVENTION

The invention is characterized in connection with the described assembly in that between the intake device and the opening means, there is provided at least one intermediate roller having a relative small diameter and a speed higher than that of the roller or rollers of the intake device. The intermediate roller serves for the fiber acceleration and shall have a diameter less than 400 mm, preferably about 100–250 mm. The peripheral speed of the intermediate roller should be at least above 600 m/min., preferably within the range of 2100 m/min.

The ratio of the peripheral speed of the intermediate roller to that of the opening roller is increased once more and may be 1:1 ⅓, preferably 1:2 and more.

Due to a cleaning and opening apparatus designed this way, essential advantages are combined. The intermediate roller ensures that a higher centrifugal force may be exerted in the associated cleaning zone and in connection with the transfer of the fiber flow from the intermediate roller to the opening roller whose rotational speed is still higher. A higher speed of the fibers at the cleaning assembly is accompanied by a substantially improved cleaning and opening operation without a fiber deterioration. This is not only true for cotton, for which a high cleaning intensity is realized, by also for waste, fiber mixtures and synthetic fibers. Thus, a universal fine opening and cleaning is possible without the need of substantially changing the assembly. The stepwise increase of the peripheral speeds effected by one or more intermediate rollers to the opening roller is responsible for a high cleaning intensity without fiber damages. Further, it is possible to remove and separate from the fiber material dirt particles, e.g. husks, etc., without comminuting them. This avoids the formation of small dirt particles which may be hard to remove later from the fiber material. The waste materials originating from the intermediate roller or rollers and from the opening roller basically differ from each other so that one may speak of an automatic classification of the type of waste. In case of the intermediate roller, the amount of waste in the separated material is so high that most of the waste may not be further used. A recovery of fibers from waste is only worthwhile in a few cases. On the other hand, waste originating from the cleaning assembly at the opening roller may be used again. Fibers may be recovered from the waste. As a consequence, waste resulting from one or more intermediate rollers and waste from the opening roller may be discharged separately and kept apart to the complete waste disposal. A common discharge is certainly also possible. The amounts of throughput obtainable with the total apparatus are far beyond about 200 kgs. per hour without a sacrifice of any of the disclosed advantages.

For the fiber flow, there may be mounted at the opening roller, a tangentially extending suction means which forms a transition from the opening roller to a suction tube having, for instance, a circular cross-section. The lower portion of the transitional structure should extend beyond the length of the opening roller, thus allowing a lateral air access. By the additional air access, a turbulence is avoided in the transitional portion or channel. This is also possible by a simple air supply, e.g. by a supporting frame opening, tube or the like.

The transitional channel, seen in cross-section, advantageously comprises a nozzle-type tapered feed portion and a nozzle-type flared discharge portion. The flow coarse is free of turbulences, if, subsequent to the opening roller, the transitional channel includes a parallel-walled section.

It is also desirable to combine the assembly for cleaning and opening with a feeder, provided directly in advance of the cleaner, by taking care that the fiber material is introduced through an intake means, is disintegrated by a disintegrator, e.g. by a beater roller. The fiber material is compacted under control in a shaft, preferably by means of an air current, to be subsequently drawn away continuously by take-off rollers. The discharged nonwoven mat may be fed via a chute to the combined opening and cleaning apparatus. Thus, it is possible to control the amount of the fiber material fed to the cleaner, etc.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
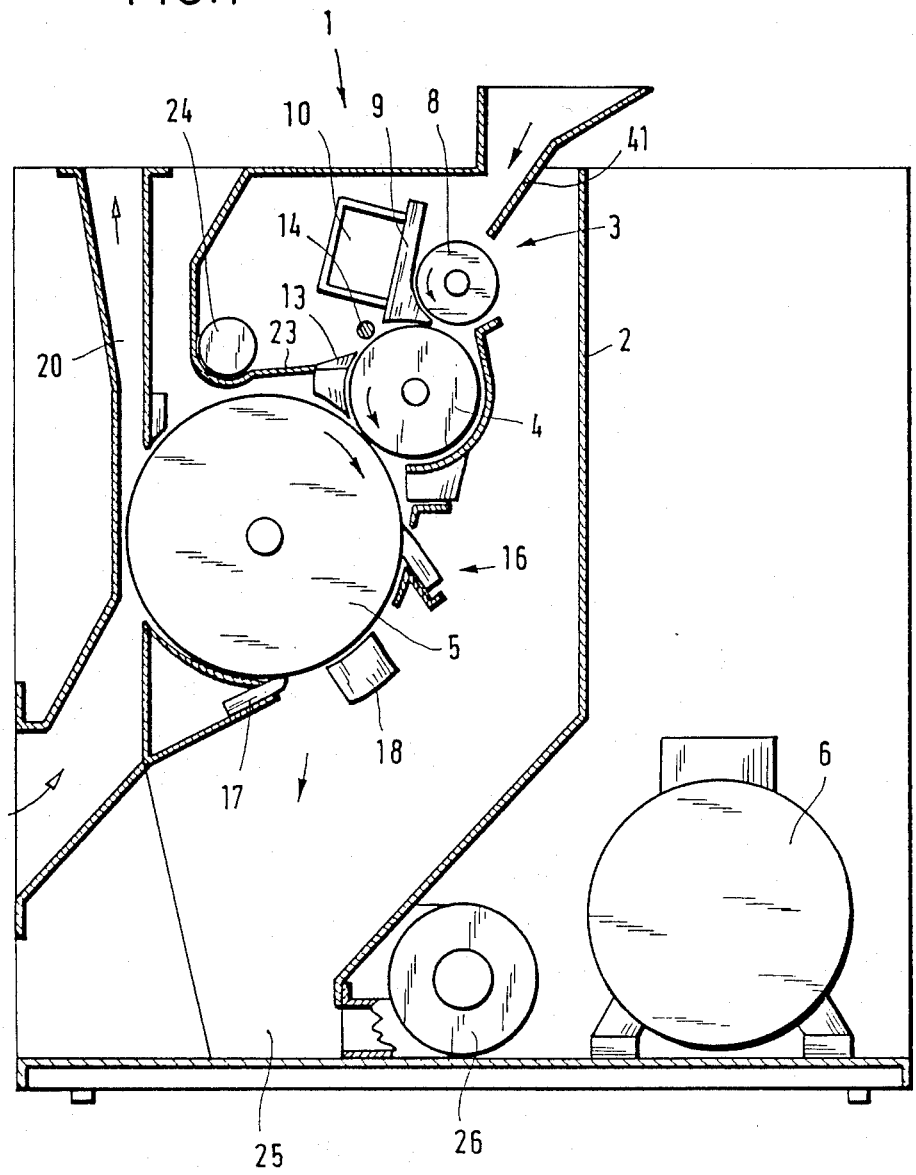
FIG. 1 shows a schematic plan view of the cleaning and opening apparatus of the invention.
Figure 2:
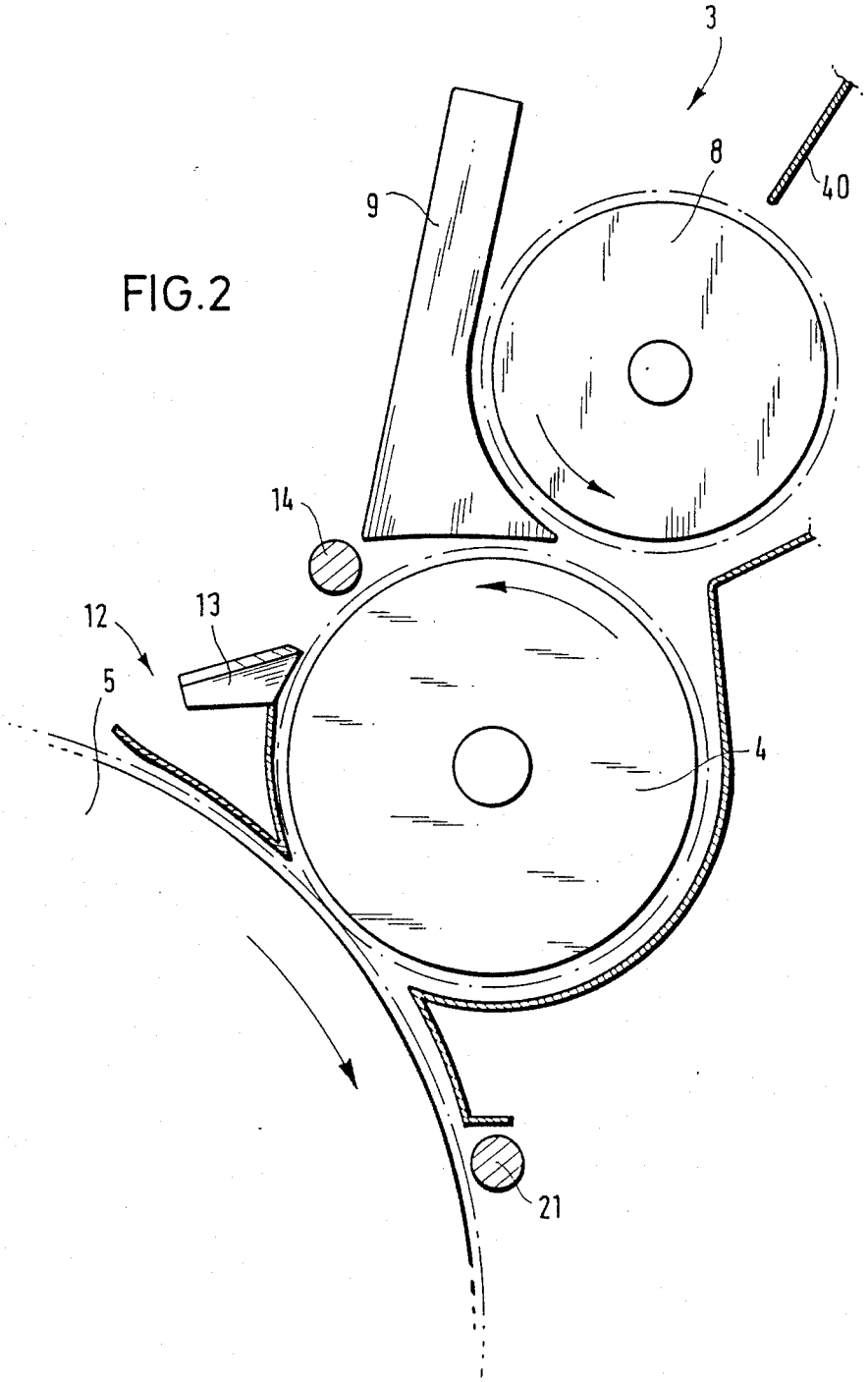
FIG. 2 is a scaled up detail of the cleaning apparatus of FIG. 1.
Figure 4:
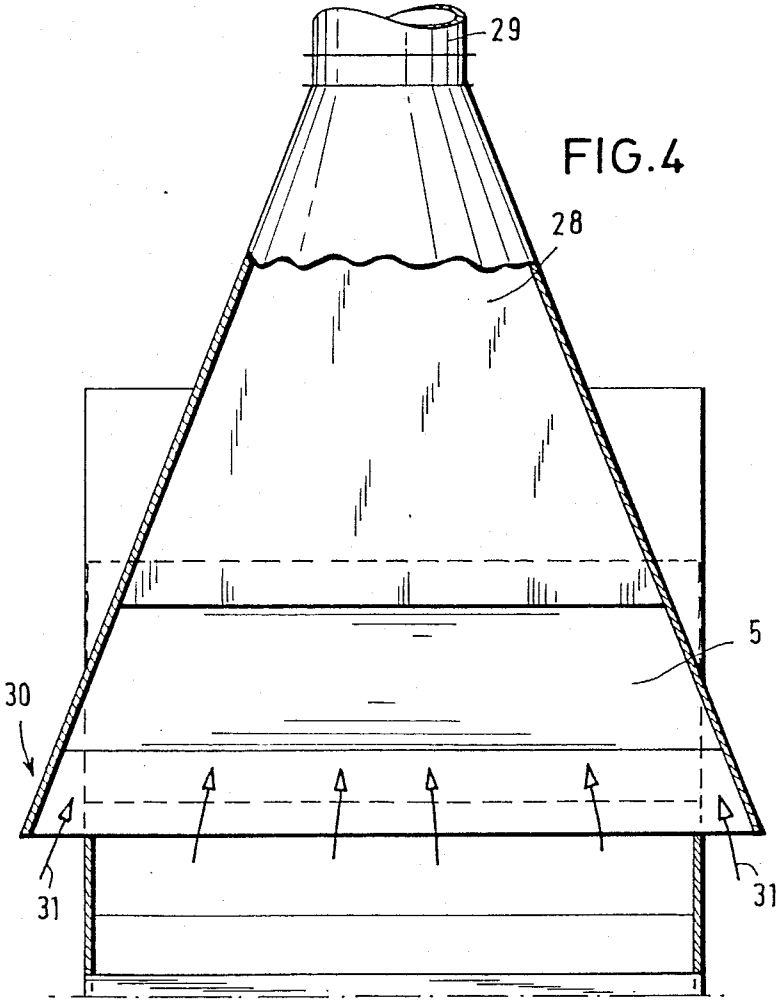
FIG. 4 is another schematic illustration of an embodiment of the cleaner of the invention in combination with a feeder.

A cleaning and opening apparatus 1 comprises a housing 2 adapted to accommodate an intake means 3, an intermediate roller 4, and an opening roller 5 which are supported pivotally. A drive motor 6 with transmission elements is provided for driving the respective rollers. The illustrated intake means consists of an adjustable intake roller 8 cooperating with a trough plate 9 that is mounted adjustably at a cross traverse 10. The intermediate roller 4 cooperates with a cleaner 12 which may consist of one or more successive knives 13. It is further possible to provide a cross bar 14 for regulating the amount to be delivered to the knife means 13. The distance between the cross bar 14 and the peripheral surface of the intermediate roller 4 is adjustable.

Further, at the opening roller 5, there may be arranged two or more further fiber separation grid cleaning devices in the form of knife edges 16 and 17 preferably spaced mutually by at least one carding element 18. At the rear side of the opening roller 5, there is a suction channel 20 extending tangentially to roller 5. Moreover, in advance of the separator 16, there may also be mounted one or more bars 21 extending parallel to the axis of the opening roller to control the fiber flow to the knife edge 16. The distance of the bars from the periphery of the opening roller 5 is adjustable.

The intake roller 8 moves relatively slow, e.g. at a peripheral speed of about 50 m/min. Compared to the opening roller 5, the diameter of the intermediate roller 4 is substantially smaller and should not exceed about 400 mm. Preferably, the diameter is still substantially smaller, e.g. within the range of 100 mm to 250 mm. However, the intermediate roller is driven at a high speed so that the peripheral speed is within the range of 600 m/minute and higher, to 2100 m/minute and higher. In case of the above mentioned embodiment, the opening roller 5 may have a diameter of 420 to about 500 mm. Due to its drive, its peripheral speed is higher than that of the intermediate roller 4, e.g. 1750 m/minute and more, e.g. about 4200 m/minute. Suitably, the ratio of the peripheral speeds of the intermediate roller 4 to the opening roller 5 is 1:1 ⅓ to 1:2. If necessary, the ratio may be even greater. The speeds of the rollers are high. Due to the high speed differences between the rollers, the cleaning effect based on the speed jump is intense for the fiber material. In spite of the considerable cleaning intensity, the fibers are not damaged. The speed transition from the intake roller to the opening roller is performed in two steps, if one intermediate roller is provided only, while more than two steps are involved with a number of intermediate rollers. Thus, a perfect fine opening of the fiber material accompanied by a high cleaning intensity are ensured.

The disclosed speed differences between rollers in conjunction with at least one intermediate roller further involves the advantageous effect that the dirt particles, e.g. husks, stalks, etc., are separated in uncomminuted or unbroken condition. As for the cleaning means 12 at the intermediate roller 4, this is effected so perfectly that the major amount of the separated material is waste which is suited, but only in a few cases, for fiber recovery. The waste from the cleaner 12 is collected in the closed housing portion 23 to be discharged through tube 24. The waste from the separators 16 and 17 drops into funnel 25 which is suited for a recovery of the fibers. Again, the separation of waste particles from the fiber flow is realized such that the dirt particles are separated from the fiber flow in a practically uncomminuted condition. The waste at both suction points 24 and 26 may be kept completely apart or discharged in common during the further waste disposal.

Figure 3:
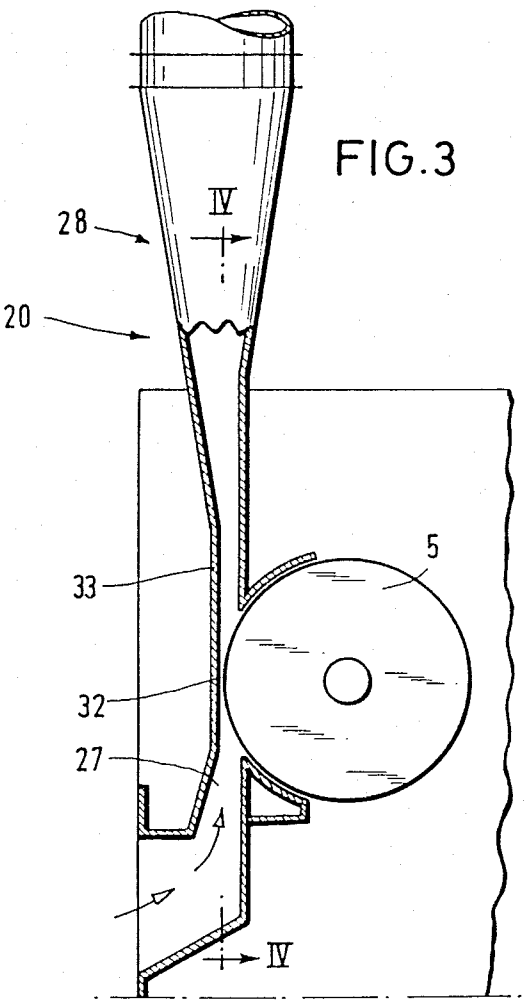
FIG. 3 is a schematic cross-section of the suction channel provided tangentially to the opening roller.
Figure 5:
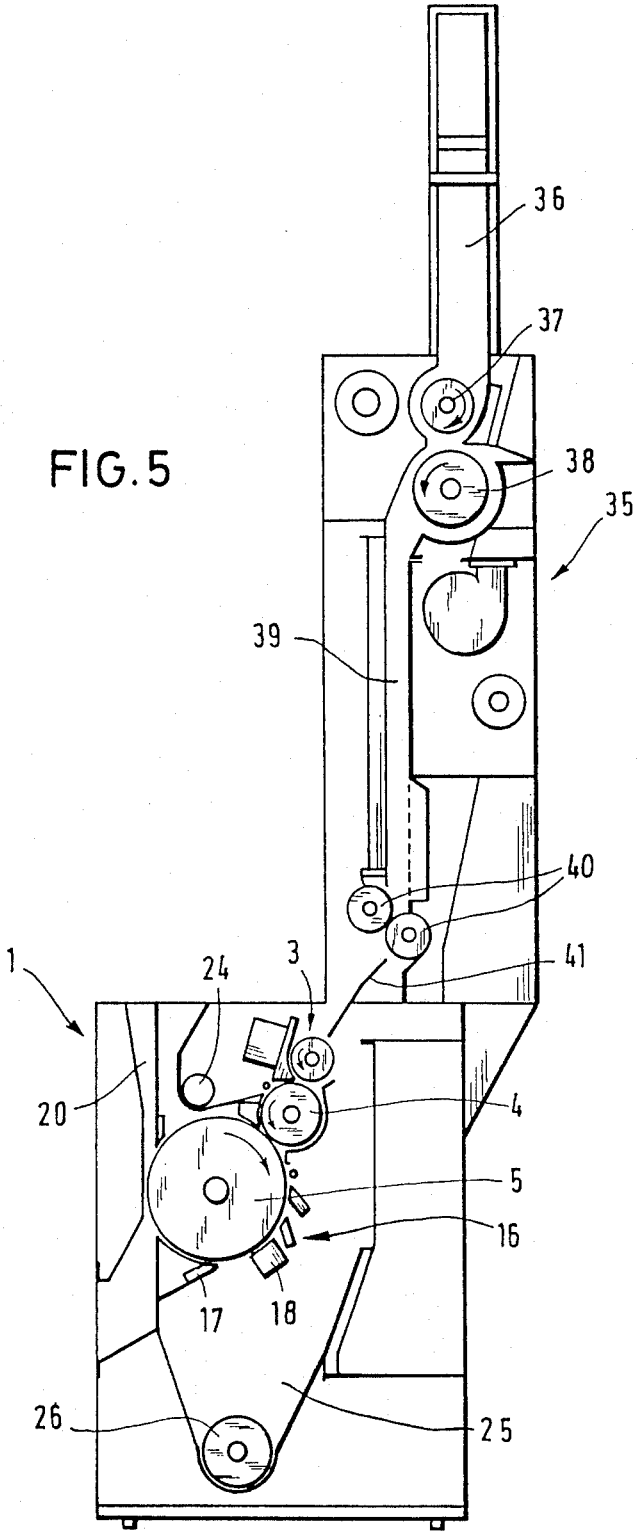

Suction channel 30 extending tangentially to opening roller 5 should be designed such that, as seen in cross-section according to FIG. 3, feed channel 27 has a nozzle-type tapered while discharge channel 28 has a substantially nozzle-type flare. Channel 28 forms a transition from the opening roller to the suction tube 9 having, for instance, a circular cross-section. The lower portion 30 of transition channel 28 suitably extends beyond the length of the opening roller 5 so that free openings are formed at points 31 through which secondary air has access to transition channel 28. Thus, turbulences in transition channel 28 are avoided. Preferably, opening roller 5 extends into the cross-section of suction channel 28 to such an extent that free cross-section 23 between opening roller 5 and wall 33 of the suction channel is very narrow. For example, cross-section 23 may be only one quarter or less of the channel cross-section at point 33 which is provided with walls in mutual parallel relationship. All these features contribute to a high sucking effect with a great freedom of turbulences.

The supply of the fiber material to cleaning and opening apparatus 1 is adjustable and the fiber material should be presented as a nonwoven fabric or mat to cleaning and opening assembly 1. For this purpose, assembly 1 is preceded by a feeder 35 which may include a feeding shaft 36 followed by a disintegrator composed of rollers 37 and 38. Roller 38 may be a beater or opening roller. The material will be conveyed to a feeding shaft 39 where it is compacted mechanically or by means of an air current. At the lower end of feeding shaft 39, there are take-off rollers 40. The discharged fiber mat will be guided via chute 41 to the combined opening and cleaning apparatus 1. By connecting the feeder 35 with the cleaning and opening apparatus 1, a controllable and monitored presentation of the nonwoven fiber material to the apparatus 1 is ensured.

Preferably, the front wall surface of housing 2 is of a tiltable design; it is, for instance, pivotable about a lower hinge parallel to the rollers. By this means, an easy access to the machine elements accommodated in the housing and a facilitated assembly and maintenance are ensured.

While a preferred embodiment of the invention has been described using specific terms, such description is for illustrative purposes only, and it is to be understood that changes and variations may be made without departing from the spirit or scope of the following claims.

What is claimed is:

1. Textile apparatus for cleaning and opening flocks of fiber material in which the fiber material is first passed to an intake means cooperating with a trough, and subsequently to an opening roller having an associated cleaning device to be finally discharged to a processing machine, characterized in that between the intake means and the opening roller there is disposed at least one intermediate roller having a relatively smaller diameter and higher rotating speed than said opening roller.

2. Apparatus of claim 1, wherein the diameter of the intermediate roller is less than 400 mm, and its peripheral speed is above 600 meters per minute.

3. Apparatus of claim 2, wherein the diameter of the intermediate roller is preferably in the range of 100 to 250 mm.

4. Apparatus of claim 1, wherein the ratio of the peripheral speed of the intermediate roller to the opening roller is at least 1:1 ⅓.

5. Apparatus of claim 1, wherein the ratio of the peripheral speed of the intermediate roller to the opening roller is greater than 1:1.5.

6. Apparatus of claims 1 including a cleaning means disposed adjacent said intermediate roller; said intermediate roller cooperating with said cleaning means to create waste material; and means for keeping the waste material from said cleaning means separate from waste material produced by said cleaning device associated with said opening roller.

7. Apparatus of claim 1 including two cleaning means disposed adjacent said opening roller; and at least one carding element disposed between said cleaning means.

8. Apparatus of claim 1 including at least one longitudinal bar disposed in advance of said cleaning means of said intermediate roller; said longitudinal bar being adjustable relative to the intermediate roller and the cleaning means.

9. Apparatus of claim 1, characterized in that the intake means is preceded by a fiber feeding device in which the fiber material is introduced via feed means, and is compacted in a shaft to be finally supplied by delivery rollers via a chute to said intake means in the form of a fiber batt.

10. Textile apparatus for cleaning and opening flocks of fiber material in which the fiber material is first passed to an intake means cooperating with a trough, and subsequently to an opening roller having an associated cleaner, to be finally discharged to a processing machine, wherein said apparatus includes a tangential suction means disposed adjacent said opening roller for the fiber flow; said tangential suction means having a suction tube and a transitional portion extending from the opening roller to said suction tube, a lower part of said transition portion projecting beyond the length of the opening roller to allow secondary air access.

11. Apparatus of claim 10, wherein said transition portion includes a nozzle-type feed portion having a tapered cross-section and a nozzle-type discharge portion having a flared cross-section and a parallel-walled transitional section adjacent said opening roller.

12. Apparatus of claim 11, wherein the opening roller extends into the cross-section of the parallel transitional section; and a free space defined between said opening roller and an opposite wall of said parallel transitional section is narrowed, as seen in the transverse plane of the opening roller.

13. Apparatus of claim 11, wherein said free space is less than about one-quarter of the cross-section of said parallel transitional section.

14. Apparatus of claim 10, characterized in that the intake means is preceded by a fiber feeding device in which the fiber material is introduced via feed means, and is compacted in a shaft to be finally supplied by delivery rollers via a chute to said intake means in the form of a fiber batt.

15. Textile apparatus for cleaning and opening flocks of fiber material of the type in which the fiber material is first delivered to an intake means and subsequently to an opening roller having an associated cleaning device, and afterwards discharged to a textile processing machine, said apparatus comprising:

a vertical textile chute feed having means for forming and feeding textile material in the form of a fiber batt;

intake means for receiving said fiber batt;

at least one opening roller to which fiber material from said fiber batt is delivered;

at least one intermediate roller disposed between said intake means and said opening roller for delivering said fiber material from said intake means to said opening roller; and said intermediate roller having a relative diameter smaller than the diameter of said opening roller, and said intermediate roller rotating at a higher speed than said opening roller.

16. Apparatus of claim 15 including cleaning means disposed adjacent said intermediate roller in a fiber cleaning relation.

17. Apparatus of claim 15, wherein the diameter of said intermediate roller is in a range of about 100 to 400 mm.

18. Apparatus of claim 15, wherein the ratio of the peripheral speed of the intermediate roller to the opening roller is in a range of about 1:1 ⅓ to 1:1.5.

19. Apparatus of claim 15 including two cleaning means disposed adjacent said opening roller; and at least one carding element disposed between said cleaning means.

20. Apparatus of claim 15 including at least one elongated bar means disposed in abeyance of said cleaning means of said intermediate roller.

21. Apparatus of claim 15 including suction means disposed adjacent said opening roller which includes a lower part which extends laterally beyond the length of the opening roller to allow the passage of secondary air to said suction means.

* * * * *